US007872563B2

(12) United States Patent
Braun et al.

(10) Patent No.: US 7,872,563 B2
(45) Date of Patent: Jan. 18, 2011

(54) VARIABLY POROUS STRUCTURES

(75) Inventors: Paul V. Braun, Savoy, IL (US); Xindi Yu, Urbana, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 929 days.

(21) Appl. No.: 11/733,151

(22) Filed: Apr. 9, 2007

(65) Prior Publication Data

US 2008/0246580 A1 Oct. 9, 2008

(51) Int. Cl.
*H01C 7/10* (2006.01)

(52) U.S. Cl. ..... 338/20; 204/483; 428/304.4

(58) Field of Classification Search ..... 338/20; 424/489, 400, 490; 264/43, 259, 625, 628; 205/79, 317; 204/483; 428/304.4
See application file for complete search history.

(56) References Cited

U.S. PATENT DOCUMENTS

| | | | |
|---|---|---|---|
| 4,707,341 | A | 11/1987 | Koch et al. |
| 6,355,198 | B1 | 3/2002 | Kim et al. |
| 6,409,907 | B1 | 6/2002 | Braun et al. |
| 6,478,994 | B1 | 11/2002 | Sneddon et al. |
| 6,541,539 | B1 | 4/2003 | Yang et al. |
| 6,669,961 | B2 | 12/2003 | Kim et al. |
| 6,957,511 | B1 | 10/2005 | Leigh et al. |
| 2004/0072687 | A1 | 4/2004 | Sekiba et al. |
| 2004/0188326 | A1 | 9/2004 | Tonkovich et al. |
| 2005/0077226 | A1 | 4/2005 | Bishop et al. |
| 2006/0140843 | A1 | 6/2006 | Sung et al. |
| 2008/0246580 | A1 | 10/2008 | Braun et al. |

FOREIGN PATENT DOCUMENTS

| | | |
|---|---|---|
| JP | 03/229050 | 8/2003 |
| JP | 04/175824 | 6/2004 |
| WO | WO 00/21905 | 4/2000 |
| WO | WO 03/062134 | 7/2003 |
| WO | WO 2004/053205 | 6/2004 |
| WO | WO 2005/075379 | 8/2005 |
| WO | WO 2007/044046 | 4/2007 |
| WO | WO 2008/124343 | 10/2008 |

OTHER PUBLICATIONS

Zhang, W.Y., et al., "Robust Photonic Band Gap from Tunable Scatterers", Physical Review Letters, 84, No. 13, pp. 2853-2856, (2000).
Fleming, J.G., et al., "All-metallic three-dimensional photonic crystals with a large infrared bandgap", Nature, 417, pp. 52-55, (2002).
Lin, S.Y., et al., "Three-dimensional photonic-crystal emitter for thermal photovoltaic power generation", Applied Physics Letters, 83, No. 2, pp. 380-382, (2003).

(Continued)

*Primary Examiner*—Kyung Lee
(74) *Attorney, Agent, or Firm*—Brinker Hofer Gilson & Lione

(57) ABSTRACT

A method of making a monolithic porous structure, comprises electrodepositing a material on a template; removing the template from the material to form a monolithic porous structure comprising the material; and electropolishing the monolithic porous structure.

18 Claims, 7 Drawing Sheets

OTHER PUBLICATIONS

Ozbay, E., "Plasmonics: Merging Photonics and Electronics at Nanoscale Dimensions", Science, 311, pp. 189-193, (2006).
Puscasu, I., et al., "Extraordinary emission from two-dimensional plasmonic-photonic crystals", Journal of Applied Physics, 98, pp. 013531-1-013531-6, (2005).
Baraton, M.I., et al., "Investigation of the Gas Detection Mechanism in Semiconductor Chemical Sensors by FTIR Spectroscopy", Synthesis and Reactivity in Inorganic, Metal-Organic, and Nano-Metal Chemistry, 35, pp. 733-742, (2005).
Banhart, J., "Manufacture, characterization and application of cellular metals and metal foams", Progress in Materials Science, 46, pp. 559-632, (2001).
Pokrovsky, A.L., et al., "Theoretical and experimental studies of metal-infiltrated opals", Physical Review B, pp. 165114-1-165114-5, (2005).
Li, W., et al., "Fabrication and optical characterization of gold-infiltrated silica opals", J. Phys.-Condens. Matter, 17, pp. 2177-2190, (2005).
von Freymann, G., et al., "Tungsten inverse opals: the influence of absorption on the photonic band structure in the visible spectral region", Applied Physics Letters, 84, No. 2, pp. 224-226, (2004).
Bartlett, P.N., et al., "Electrochemical deposition of macroporous magnetic networks using colloidal templates", Journal of Materials Chemistry, 13, pp. 2596-2602, (2003).
Juarez, B.H., et al., "Formation of Zinc Inverted Opals on Indium Tin Oxide and Silicon Substrates by Electrochemical Deposition", J. Phys. Chem. B, 108, pp. 16708-16712, (2004).
Bartlett, P.N., et al., "Optical properties of nanostructured metal films", Faraday Discuss. 125, pp. 117-132, (2004).
Bartlett, P.N., et al., "Electrochemical deposition of macroporous platinum, palladium and cobalt films using polystyrene latex sphere templates", Chem. Commun., pp. 1671-1672, (2000).
Kelf, T.A., et al., "Plasmonic Band Gaps and Trapped Plasmons on Nanostructured Metal Surfaces", Physical Review Letters, 95, pp. 116802-1-116802-4, (2005).
Cole, R. M., et al., "Easily Coupled Whispering Gallery Plasmons in Dielectric Nanospheres Embedded in Gold Films", Physical Review Letters, 97, 137401-1-137401-4, (2006).
Ebbesen, T.W., et al., "Extraordinary optical transmission through sub-wavelength hole arrays", Nature, vol. 391, pp. 667-669, (1998).
Chan, D.L.C., et al., "Thermal emission and design in one-dimensional periodic metallic photonic crystal slabs", Physical Review E, 74, pp. 016609-1-016609-9, (2006).
Escuti, M.J., et al., "Holographic photonic crystals", Opt. Eng., 43(9), pp. 1973-1987, (2004).
Gratson, G.M., et al., "Direct writing of three-dimensional webs", Nature, 428, pp. 386, (2004).
Jeon, S., et al., "Fabricating complex three-dimensional nanostructures with high-resolution conformable phase masks", Proc. Natl. Acad. Sci. U.S.A., 101, pp. 12428-12433, (2004).
Colvin, V.L., "From Opals to Optics: Colloidal Photonic Crystals", MRS Bulletin, pp. 637-641, (2001).
Leunissen, M.E., et al., "Ionic colloidal crystals of oppositely charged particles", Nature, vol. 437, pp. 235-240, (2005).
Hoogenboom, J.P., et al., "Template-Induced Growth of Close-Packed and Non-close-Packed Colloidal Crystals during Solvent Evaporation", Nano Letters, vol. 4, No. 2, pp. 205-208, (2004).
Valignat, M.P., et al., "Reversible self-assembly and directed assembly of DNA-linked micrometer-sized colloids", Proc. Natl. Acad. Sci. U.S.A., vol. 102, No. 12, pp. 4225-4229, (2005).
Russel, W.B., "Tunable colloidal crystals", Nature, vol. 421, pp. 490-491, (2003).
Gratson, G.M., et al., "Direct-Write Assembly of Three-Dimensional Photonic Crystals: conversion of Polymer Scaffolds to Silicon Hollow-Woodpile Structures", Advanced Materials, 18, pp. 461-465, (2006).
Abbott, A.P., et al., "Application of ionic liquids to the electrodeposition of metals" Physical Chemistry Chemical Physics, 8, pp. 4265-4279, (2006).
Endres, F., et al., "Air and water stable ionic liquids in physical chemistry", Physical Chemistry Chemical Physics, 8, pp. 2101-2116, (2006).
Littlefuse, "C H Varistor Series", Found at http://www.littelfuse.com/data/en/Data_Sheets/Littelfuse_MOV_CH.pdf (Last Updated: Jan. 11, 2007), 6 pages.
Gates, B., et al., "Fabrication and Characterization of Chirped 3D Photonic Crystals", Advanced Materials, 12, No. 18, pp. 1329-1332, (2000).
Park, S.H., et al, "Fabrication of Three-Dimensional Macroporous Membranes with Assemblies of Microspheres as Templates", Chem. Mater., 10, pp. 1745-1747, (1998).
Gates, B., et al., "Fabrication and Characterization of Porous Membranes with Highly Ordered Three-Dimensional Periodic Structures", Chem. Mater., 11, pp. 2827-2836, (1999).
van Blaaderen, A., et al., "Template-directed colloidal crystallization", Nature, vol. 385, pp. 321-324, (1997).
Yu, X., et al., "Filling Fraction Dependent Properties of Inverse Opal Metallic Photonic Crystals", Advanced Materials, 19, pp. 1689-1692, (2007).
Yu, et al., "Variable Filling Fraction Inverse Opal Metallic Photonic Crystals", MRS Spring Meeting Abstract, 1 page, (2007).
"Varistor", Found at http://en.wikipedia.org/wiki/Varistor, (last modified on Mar. 19, 2008), 5 pages.
Kucheyev, S.O. et al., "Synthesis and electronic structure of low-demsity monoliths of nanoporous nanocrystalline anatase Ti02", Journal of Electron Spectroscopy and Related Phenomena, Elsevier Science Publishers, Amsterdam, NL, vol. 144-147, pp. 609-612, (2005).
International Search Report dated Oct. 13, 2008 for PCT application No. PCT/US2008/058657.
Arana, L.R, et al, "A microfabricated suspended-tube chemical reactor for fuel processing", The Fifteenth IEEE International Conference on Micro Electro Mechanical Systems, pp. 232-235, (2002).
Armor, J.N, et al, "Studying carbon formation at elevated pressure", Applied Catalysis A, General 206, pp. 231-236 (2001).
Star Fire Systemstm home page at http://www.starfiresystems.com/ (2004).
Ameel, T.A, et al, "Miniaturization Technologies applied to Energy Systems", Energy Convers. Mgmt, vol. 38, No. 10-13, pp. 969-982, (1997).
Jensen, K.F, "Microchemical systems: status, challenges, and opportunities", AIChE Journal, vol. 45, No. 10, pp. 2051-2054, (1999).
Weitkamp, J, "Zeolites and catalysis", Solid State Ionics, vol. 131, pp. 175-188, (2000).
Corma, A, "From microporous to mesoporous molecular sieve materials and their use in catalysis", Chem. Rev, vol. 97, pp. 2373-2419, (1997).
Velev, O.D, et al, "Porous silica via colloidal crystallization", Nature, vol. 389, pp. 447-448, Oct. 2, 1997.
Wijnhoven, J.E.G.J, et al, "Preparation of photonic crystals made of air spheres in titania", Science, vol. 281, pp. 802-804, Aug. 7, 1998.
Subramania, G, et al, "Optical photonic crystals fabricated from colloidal systems", Applied Physics Letters, vol. 74, No. 26, pp. 3933-3935, (1999).
Ryoo, R, et al, "Synthesis of highly ordered carbon molecular sieves via template-mediated structural transformation", Journal of Physical Chemistry B, vol. 103, No. 37, pp. 7743-7746, Sep. 16, 1999.
Yoon, S.B, et al, "Synthesis of highly ordered Nanoporous carbon molecular sieves from silylated MCM-48 using divinylbenzene as precursor", Chem Commun, pp. 559-560, (2001).
Yang, P, et al, "Patterning porous oxides within microchannel networks", Adv. Mater, vol. 13, No. 6, pp. 427-431, (2001).
Trau, M, et al, "Microscopic patterning of orientated mesoscopic silica through guided growth", Nature, vol. 390, pp. 674-676, (1997).
Huppertz, H, et al, "Ba2Nd7Si11N23- A nitridosilicate with a zeolite-analogous Si-N structure", Angew. Chem. Int. Ed. Engl, vol. 36, No. 23, pp. 2651-2652, (1997).
Sung, I.K, et al, "Fabrication of macroporous SiC from templated preceramic polymers", Chem. Commun, pp. 1480-1481, (2002).
Yang, H, et al, "Fabrication of high performance ceramic microstructures from a polymeric precursor using soft lithography", Adv. Mater, vol. 13, No. 1, pp. 54-58, (2001).

Kim, E, et al, "Micromolding in capillaries: Applications in materials science", J. Am. Chem. Soc, vol. 118, pp. 5722-5731 (1996).
Technical Data Sheet 238, "Polystyrene Microspheres: Frequently Asked Questions", pp. 1-5, Polysciences, Inc, Mar. 2004.
Product information sheet for KION® VL20 Polysilazane pp. 1-3, (KiON Corp, 2004).
Kroke, E, et al, "Silazane derived ceramics and related materials", Material Science and Engineering, vol. 26, pp. 97-199, (2000).
Arabczyk, W, et al, "Study of the ammonia decomposition over iron catalysts", Catalysis Letters 60, pp. 167-171, (1999).
Duffy, D.C, et al, "Rapid prototyping of microfluidic systems in poly(dimethylsiloxane)", Anal. Chem, vol. 70, No. 23, pp. 4974-4984, Dec. 1, 1998.
Omatete, O.O, et al, "Gelcasting: From Laboratory Development Toward Industrial Production", Journal of the European Ceramic Society, vol. 17, pp. 407-413, (1997).
Chang, Y-H, et al, "Syntheses of nano-sized cubic phase early transition metal carbides from metal chlorides and n-butyllithium", J. Mater. Chem, vol. 12, pp. 2189-2191, (2002).
Sieber, H, et al, "Processing of biomorphous TiC-based ceramics", Ceramic Engineering and Science Proceedings 24 (3), 27th Annual Cocoa Beach Conference on Composites, Advanced Ceramics, Materials, and Structures: B ed, pp. 135-140, (2003).
Pattekar, A.V, et al, "Fuel processing microreactors for hydrogen production in micro fuel cell applications", 7th International Conference on Microreaction Technology (IMRET-7), Lausanne, Switzerland, Sep. 7-10, 2003.
Herbell, T.P, et al, "Hot Hydrogen Exposure Degradation of the Strength of Mullite", J. Am. Ceram. Soc, vol. 81, No. 4, pp. 910-916, (1998).
Herbell, T.P, et al, "Effect of Hydrogen on the Strength and Microstructure of Selected Ceramics", Environmental Effects on Advanced Materials, The Minerals, Metals & Materials Society, pp. 159-172, (1991).
Sung, I-K, et al, "Fabrication of Porous SiC-Based Ceramics Within Microchannel Networks for High Temperature Microreactors", Presentation at MRS Meeting, pp. 354, Apr. 20-25, 2003.
Product information sheet for International Mezzo Technologies, Chemical Reactors, pp. 1-2, Oct. 21, 2004.
Holladay, J.D, et al, "Microfuel processor for use in a minature power supply", Journal of Power Sources, vol. 108, pp. 21-27, (2002).
Product list KiON® CERASET® Polyureasilazane and KiON® VL20 Polysilazane pp. 1-2, (KiON Corp, 2001).
Sieber, H, et al, "Gas phase processing of Porous, Biomorphous TiC-Ceramics", vols. 264-268, pp. 2227-2230, (2004).
Park, K-H, et al, "A facile route to prepare high surface area mesoporous SiC from SiO2 sphere templates", Journal of Materials Chemistry, vol. 14, pp. 3436-3439, (2004).
Ganley, J.C, et al, "Development of a microreactor for the production of hydrogen from ammonia", Journal of Power Sources, vol. 137, pp. 53-61, (2004).
Liew, L-A, et al, "Fabrication of SiCN MEMS by photopolymerization of pre-ceramic polymer", Sensors and Actuators A Physical, vol. 95, pp. 120-134 (2002).
Liu, Y, et al, "Application of microforging to SiCN MEMS fabrication", Sensors and Actuators A, vol. 95, pp. 143-151, (2002).
Pattekar, A.V, et al, "A microreactor for hydrogen production in micro fuel cell applications", Journal of Microelectromechanical Systems, vol. 13, No. 1, pp. 7-18, (2004).
Sung, I-K, et al, "Tailored macroporous SiCN and SiC structures for high-temperature fuel reforming", Advanced Functional Materials, vol. 15, pp. 1336-1342, (2005).
Wang, H, et al, "Fabrication and characterization of ordered macroporous PMS-derived SiC from a sacrificial template method", Journal of Materials Chemistry, vol. 14, pp. 1383-1386, (2004).
Wang, H, et al, "Preparation of three-dimensional ordered macroporous SiCN ceramic using sacrificing template method", Microporous and Mesoporous Materials, vol. 80, pp. 357-362, (2005).
Weimer, A.W, et al, Processing and properties of nanophase SiC/Si3N4 composites, Composites Part B: engineering, vol. 30, pp. 647-655, (1999).
International Search Report and Written Opinion dated Jun. 11, 2007 for PCT application No. PCT/US2005/046513.
Hoa, M.L.K. et al, "Preparation of porous material with ordered hole structure", Advances in Colloid and Interface Science, vol. 121, pp. 9-23, (2006).
Rugge, A. et al, "Tungsten nitride inverse opals by atomic layer deposition", Nano Letters, vol. 3, No. 9, pp. 1293-1297, (2003).
Sung, I-K. et al, "Tailored macroporous SiCN and SiC structures for high-temperature fuel reforming", Advanced Functions Materials, vol. 15, pp. 1336-1342, (2005).
Velev, O.D. et. al, "Structured porous materials via colloidal crystal templating: from inorganic oxides to metals", Advanced Materials, vol. 12, No. 7, pp. 531-534, (2000).
Riedel, R. et al., "A silicoboron carbonitride ceramic stable to 2,000° C.", Nature, vol. 382, pp. 796-798, (1996).

VARIABLY POROUS STRUCTURES

FEDERALLY SPONSORED RESEARCH OR DEVELOPMENT

This subject matter of this application may have been funded in part under the following research grants and contracts: Department of Energy (through the Frederick Seitz Material Research Laboratory) award no. DEFG02-91ER45439 and the U.S. Army Research Office contract/grant no. DAAD19-03-1-0227. The U.S. Government may have rights in this invention.

BACKGROUND

Porous solids with tailored pore characteristics have attracted considerable attention as selective membranes, photonic bandgap materials, and waveguides.[36, 37] Examples include porous membranes having highly ordered monolithic structures made of oxide materials,[38] and semiconductors.[35] Three-dimensionally porous metals have also been prepared from metals such as Au, Ag, W, Pt, Pd, Co, Ni and Zn,[10-14] formed in an inverse opal structure, where the metal is present in all the spaces between face center cubic (FCC) close packed spherical voids.

Metallic photonic crystals, metal based structures with periodicities on the scale of the wavelength of light, have attracted considerable attention due to the potential for new properties, including the possibility of a complete photonic band gap with reduced structural constraints compared to purely dielectric photonic crystals,[1] unique optical absorption and thermally stimulated emission behavior,[2, 3] and interesting plasmonic physics.[4] Photonic band gap materials exhibit a photonic band gap, analogous to a semiconductor's electronic band gap, that suppress propagation of certain frequencies of light, thereby offering photon localization or inhibition of spontaneous emissions. Photonic applications may include high efficiency light sources,[5] chemical detection,[6] and photovoltaic energy conversion.[3] Other applications include acoustic damping, high strength to weight structures, catalytic materials, and battery electrodes.[7] The photonic properties of metal inverse opal structures have been of significant interest because of the simplicity of fabrication and potential for large area structures. However, in practice, experiments on metal inverse opals have been inconclusive,[8-10] presumably because of structural inhomogeneities due to synthetic limitations.

A photonic band gap material, a three-dimensionally interconnected solid, exhibiting substantial periodicity on a micron scale has been fabricated using a colloidal crystal as a template, placing the template in an electrolytic solution, electrochemically forming a lattice material, e.g., a high refractive index material, on the colloidal crystal, and then removing the colloidal crystal particles to form the desired structure.[35] The electrodeposition provides a dense, uniform lattice, because formation of the lattice material begins near a conductive substrate and growth occurs substantially along a plane moving in a single direction normal to the conductive substrate.

SUMMARY

In a first aspect, the present invention is a method of making a monolithic porous structure, comprising electrodepositing a material on a template; removing the template from the material to form a monolithic porous structure comprising the material; and electropolishing the monolithic porous structure.

In a second aspect, the present invention is a monolithic porous structure, comprising at least one member selected from the group consisting of consisting of metals, alloys, semiconductors, oxides, sulfides and halides. The monolithic porous structure has a filling fraction of 1-25%.

In a third aspect, the present invention is a varistor, comprising: a substrate, a first electrode and a second electrode on the substrate, and a monolithic porous structure in contact with both the first electrode and the second electrode. The at least one member is a metal or alloy.

DEFINITIONS

The term "particle diameter" of a collection of particles means the average diameter of spheres, with each sphere having the same volume as the observed volume of each particle.

The term "packed" means that the particles of the template material are in physical contact with each other.

DETAILED DESCRIPTION

Figure 1:
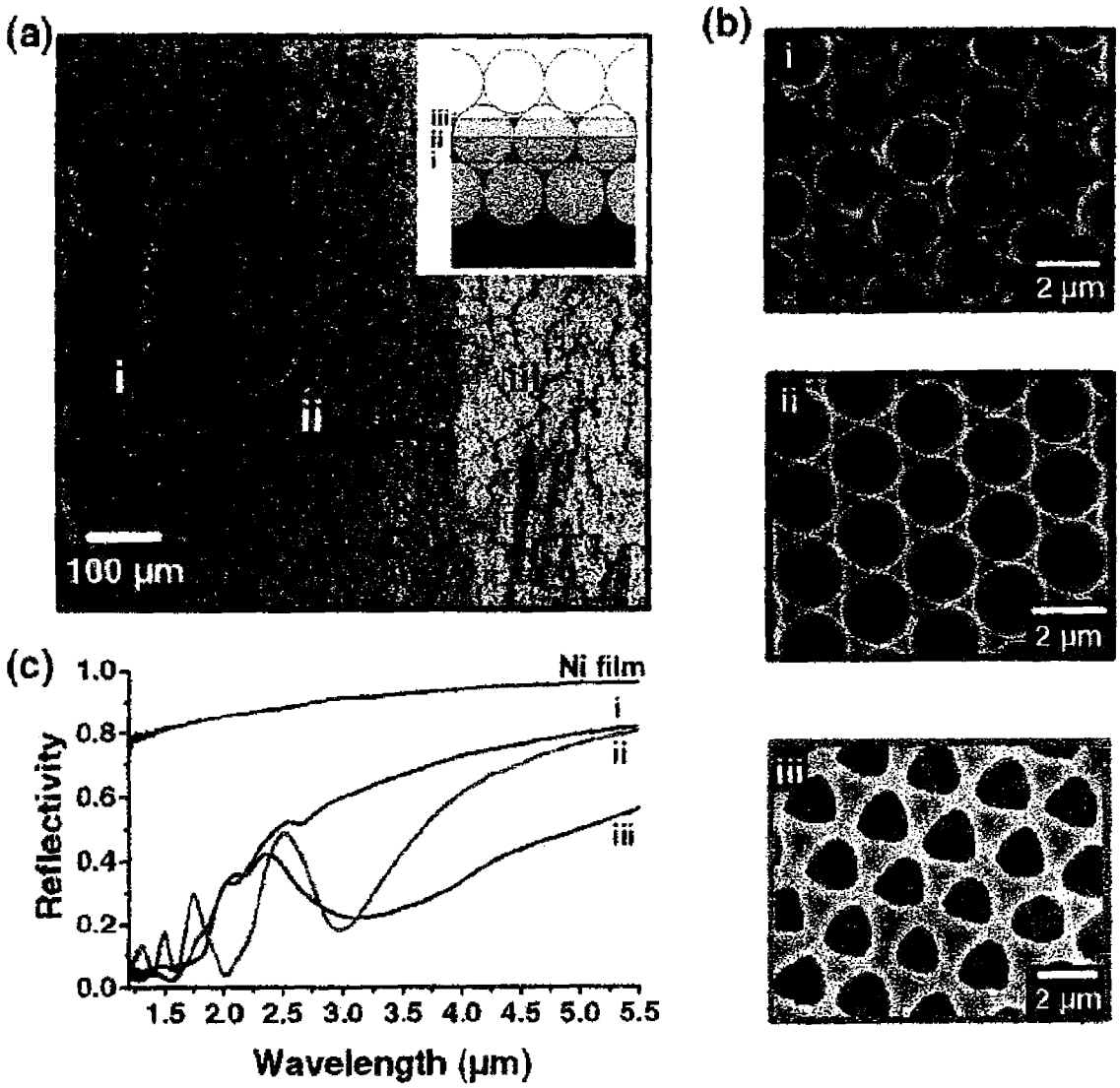
FIGS. 1(*a*), (*b*)(*i*)-(*iii*) and (*c*). Electrodeposited nickel inverse opal: (a) Optical micrograph of the nickel inverse opal; the different surface topographies appear green (i), red (ii), and yellow (iii). Inset: Nickel electrodeposition begins at the substrate and propagates upward. Top of the color bands correspond to the surface topography of three color regions observed under optical microscopy. (b)(i)-(iii) SEM images of the three different surface topographies observed in (a). (c) IR reflectance from the three color regions of an electrodeposited nickel film.

The present invention makes use of the discovery of an electrochemical approach for fabricating monolithic porous structures, with complete control over sample thickness, surface topography, pore structure, two-dimensional and three-dimensional periodicity, and for the first time, the structural openness (filling fraction). The monolithic porous structures are formed by electrodepositing a material through a template, removing the template, and then electropolishing the monolithic porous structure to decrease the filling fraction. Selection of template structure allows control over surface topography, pore structure, as well as two-dimensional and three-dimensional periodicity. Optionally, the monolithic porous structure material may be chemically modified after formation, or the surface of the monolithic porous structure may coated with a different material.

The shape, size and location of voids throughout the monolithic porous structure will match the template. The template is formed on a conductive substrate, which will act as an electrode during electrodepositing and electropolishing. The two-dimensional and three-dimensional periodicity of the monolithic porous structure will be determined by the two-dimensional and three-dimensional periodicity of the template. The template may be any shape which can be formed on a surface. Preferably the template has two-dimensional periodicity, more preferably three-dimensional periodicity. The void fraction of the monolithic porous structure will in part depend on the size distribution of the particles, the shape of the particles, and the packing arrangement. For example, if the template particles all have exactly the same size and they are packed in a perfect close packed structure, the void fraction of the monolithic porous structure will be 0.74. Preferably, the template is formed of packed particles, more preferably packed particles in a three-dimensionally ordered structure, such as a cubic close packed structure, a hexagonal close packed structure, a primitive tetragonal packed structure or a body centered tetragonal structure, each of which will result in a monolithic porous structure having a void fraction after template removal, but before electropolishing, of 74%, 74%, 72% and 70%, respectively. The void fraction may be increased, for example, by adding second template particles, having a diameter small enough, and present in a small enough amount, to fit completely within the interstices of the lattice formed by the close packed larger template particles. Alternatively, the void fraction may be decreased, for example, by adding second template particle which are smaller than the closed packed template particles, but not small enough to fit within the interstices of the lattice. Preferably, the template particles will have a narrow size distribution, but mixtures of particles of different sizes are possible. If the template is formed of packed particles (i.e. they are in physical contact with each other), the monolithic porous structure formed will have interconnecting pores.

Preferably, the particles have a particle diameter of 1 nm to 100 μm, more preferably from 40 nm to 10 μm, including 100 nm to 2 μm. This will result in a monolithic porous structure having a pore diameter which corresponds to the particle diameter (i.e. a pore diameter of 1 nm to 100 μm, more preferably from 40 nm to 10 μm, including 100 nm to 2 μm, respectively). A variety of particles are available commercially, or may be prepared as described in U.S. Pat. No. 6,669,961. The particles may be suspended in a solvent, such as water, an alcohol (such as ethanol or isopropanol), another organic solvent (such as hexane, tetrahydrofuran, or toluene), or mixtures thereof. If necessary, a surfactant may be added to aid in suspending the particles, and/or the mixture may be sonicated.

The template may contain any material which may either be dissolved or etched away, or a material which will decompose or evaporate during heating. A material which will at least partially decompose or evaporate during heating may be used, as long as any remaining material can be dissolved or etched away. Examples include polymers (such as polystyrene, polyethylene, polypropylene, polyvinylchloride, polyethylene oxide, copolymers thereof, and mixtures thereof, ceramic materials (such as silica, boron oxide, magnesium oxide and glass), elements (such as silicon, sulfur, and carbon), metals (such as tin, lead, gold, iron, nickel, and steel), and organic materials (such as pollen grains, cellulose, chitin, and saccharides).

Colloidal crystals are periodic structures typically formed from small particles suspended in solution. It is possible to form them by allowing slow sedimentation of substantially uniformly-sized particles in a liquid, such that the particles arrange themselves in a periodic manner. Other fabrication techniques are also possible. The average particle diameter of colloidal crystals ranges from 100 nm to 5 μm. It is possible to form colloidal crystals from any suitable materials.

The structure of colloidal crystals exhibits two-dimensional periodicity, but not necessarily three-dimensional periodicity. Sedimentation of the colloidal particles induces a random stacking with the close-packed planes perpendicular to gravity. Such a randomly-stacked structure does not exhibit substantial three-dimensional periodicity, because of the randomness in the gravity direction. For some applications, it is desired to have materials exhibiting substantial three-dimensional periodicity. One way to do so is to use colloidal epitaxy to form the template crystal.[39] Colloidal epitaxy involves growing a colloidal crystal normal to an underlying pattern, for example a series of holes, reflecting a particular three-dimensionally ordered crystal, such as the (100) plane of a face-centered cubic (FCC) crystal. The holes order the first layer of settling colloidal particles in a manner that controls the further sedimentation. Colloidal crystals which do not have an FCC structure have been fabricated by a variety of method, including assembly of opposite charged particles,[23] templated assistant colloidal crystal growth,[24] DNA assisted colloidal self assembly,[25] and colloidal self-assembly in an electric field.[26]

Templates may also be formed by a direct writing method to create three-dimensional structures made of different materials.[27, 20] These structures can be used as the starting point for porous metals through at least two different procedures. In the first procedure, structures can be formed on a conductive substrate such as gold or indium-tin oxide. The structure may then be directly used as a template, filling the void space in the template by electrodeposition.

In the second procedure, structures can be formed on a conductive substrate and then filled in with a second phase material such as $SiO_2$ or silicon. The initial structure can be removed, for example by calcination, and then the void space in the template is filled by electrodeposition. After removal of the second phase material, a direct copy of the initial directly written structure is produced as the monolithic porous structure. Electropolishing could then be used to dramatically reduce the filling fraction to levels of 1% or below.

Electrodeposition may be performed by any suitable electrochemical route. Generally, electrochemical techniques used to form thin films on conductive substrates (which serves as an electrode) will be suitable for forming the porous structure within the template. The electrodeposition provides a dense, uniform structure, because formation begins near the conductive substrate and moves up the template, with growth occurring substantially along a plane moving in a single direction normal to the substrate. The electrochemically grown structure is a three-dimensionally interconnected (monolithic) solid. The electrodeposition may be carried out from solution,[31, 32] or using ionic liquids.[29, 30]

The monolithic porous structure may contain any material suitable for electrodeposition. Elements, including metals, can be electrodeposited, for example Al, Si, Ti, V, Cr, Mn, Fe, Co, Ni, Cu, Zn, Ga, Ge, As, Se, Zr, Nb, Mo, Ru, Rh, Pd, Ag, Cd, In, Sn, Sb, Te, Hf, Ta, W, Re, Os, Ir, Pt, Au, TI, Pb, and Bi. Alloys and compounds of these elements may also be electrodeposited. Semiconductors, such as CdS and CdSe, may also be electrodeposited. Once the monolithic porous structure is formed, the material it contains may be transformed by chemical reaction, for example a metal may be reacted with oxygen to form a monolithic porous structure containing the corresponding oxide, or reacted with sulfur (or $H_2S$) or a halogen to form a monolithic porous structure of the corresponding sulfide or halide. In addition, once formed the monolithic porous structure may be coated by atomic layer deposition, chemical vapor deposition, or anodization. For example, a monolithic porous structure may be coated with $Al_2O_3$, $HfO_2$, $ZrO_2$, $SiO_2$ and/or $TiO_2$, to a thickness of about 20 nm, using 100 cycles of atomic layer deposition.

The electrode for the electrodeposition may be provided by any conductive substrate on which the template is formed, and which is compatible with the reagents of the specific electrodeposition. For example, it is possible to place a colloidal crystal template onto a conductive substrate, to form the crystal on a conductive substrate, or to deposit a conductive layer on one surface of the colloidal crystal. The electrode is preferably oriented so that the electrodeposition occurs along a plane moving in a single direction, in order to attain a desired density. Examples include indium-tin oxide and gold-plated or platinum-plated glass, silicon or sapphire. The conductive substrate and template are typically selected so that the template adheres well to the substrate. It is also possible to treat the substrate and template to promote adhesion.

Once electrodeposition is completed, the resulting composite material is treated to remove the template. For example, in the case of an organic colloidal crystal, the composite may be heated to burn out the organics, for example at a temperature of at least 250° C. Other techniques are also possible, such as irradiation or plasma-assisted etching of the template. For inorganic templates, an etchant may be used to remove the template, for example by exposure of a silica template to HF. Polystyrene and other organic polymer templates are easily removed after formation of the monolithic porous structure by heating or dissolving with an organic solvent. Furthermore, the conductive substrate may also be removed, for example with an etchant, to form a free-standing monolithic porous structure.

After removal of the template, electropolishing may be used to decrease the filling fraction of the monolithic porous structure. For example, a monolithic porous structure formed from a close packed particle template will have a filling fraction of 26%; this can be reduced to 25% or less, for example 1-25%, including 20%, 18%, 15%, 13%, 10%, 8%, 6%, 5%, 4% and 3%. Since electropolishing is electrodeposition in reverse, most materials which can be electrodeposited can also be electropolished. Electropolishing provides uniform and controlled removal of the material of the monolithic porous structure.

Figure 6:
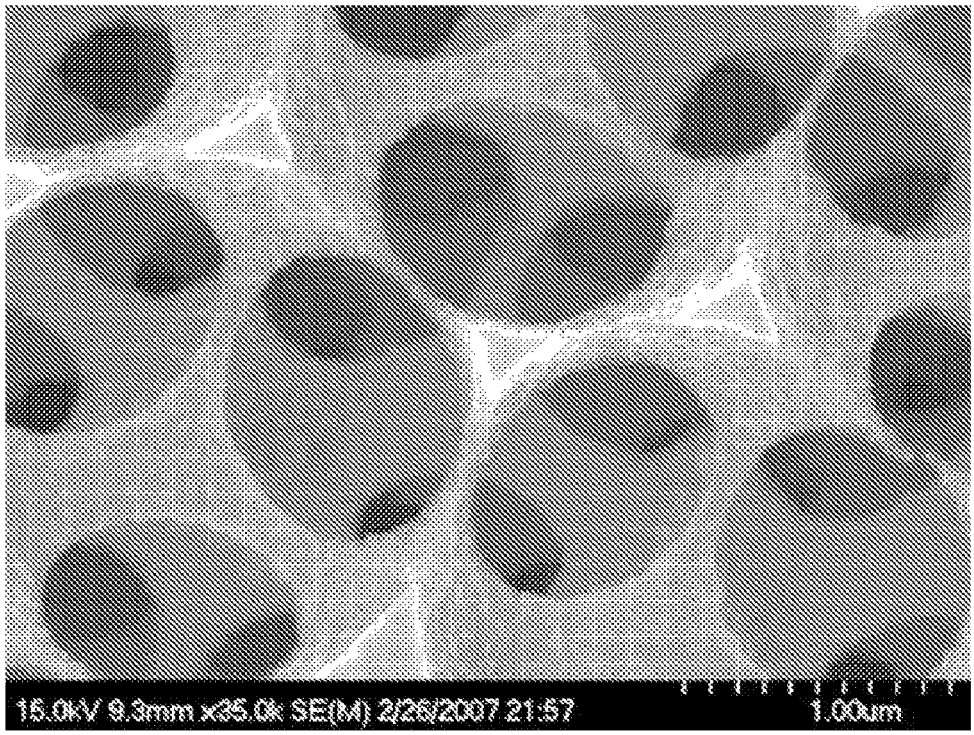
FIGS. 6 and 7. SEM images of nickel inverse opal, after electropolishing and thermal oxidation; at the thinnest regions, nickel has been completely oxidized.
Figure 7:
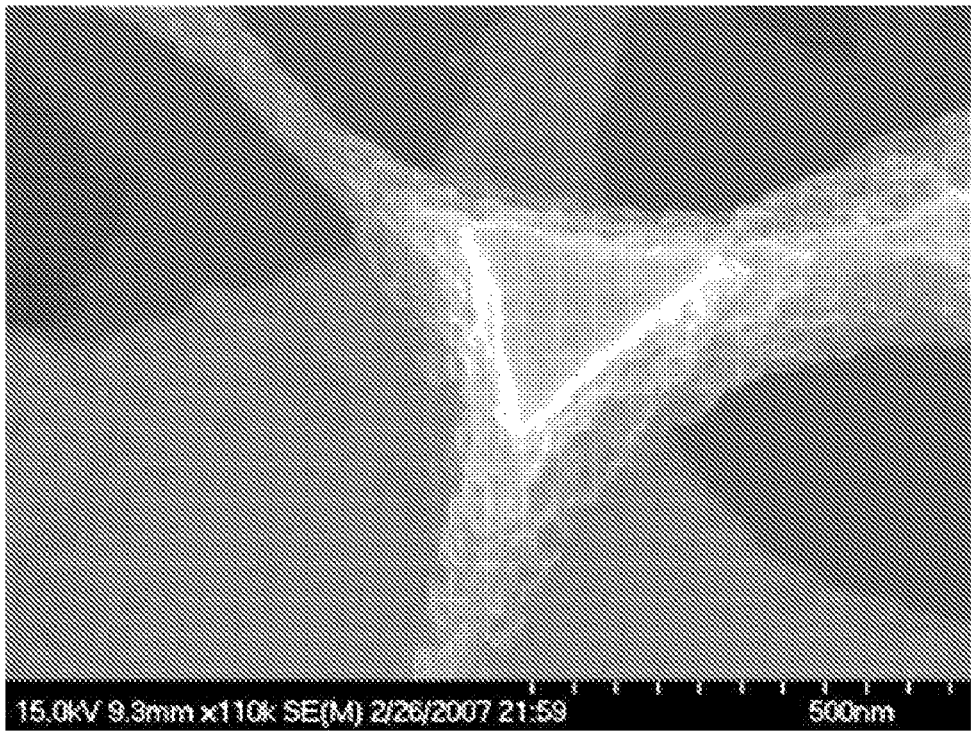
Figure 8:
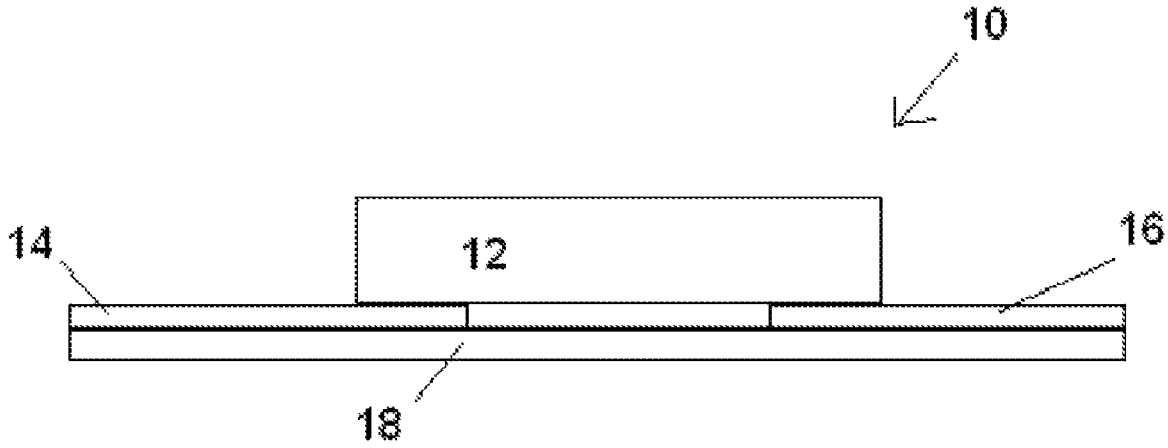
FIG. 8. A schematic of a varistor, including a monolithic porous structure.

A monolithic porous structure containing a conductive material such as a metal, for example Ni, may be formed into a varistor. Preferably, the monolithic porous structure containing a metal is formed using a close packed particle template, resulting in a monolithic porous structure having a filling fraction of 26%. Electropolishing may be used to decrease the filling fraction until the monolithic porous structure is essentially thin interconnecting wires between larger metal dots. Oxidation of the metal, while controlling the gasses used for oxidation (for example, $O_2$ concentration, humidity, $H_2S$ concentration, $H_2$ concentration, etc.) may be used to convert the interconnecting wires into an insulating material (for example, NiO). Resistivity of the monolithic porous structure may be monitored during oxidation, to monitor when the desired oxidation end point is reached. Furthermore, prior to oxidation, the monolithic porous structure may be coated, for example with $Al_2O_3$ by atomic layer deposition, to help maintain the structural integrity of the monolithic porous structure during oxidation. The resulting monolithic porous structure will have a very large number of metal/insulator junctions, which will act as back-to-back schottky diodes (as shown in FIGS. 6 and 7). A illustrated in FIG. 8, placing the monolithic porous structure 12 in contact with two electrodes 14, 16 on a substrate 18 will produce a varistor 10.

EXAMPLES

Nickel was selected because of its high reflectivity in the infra-red, temperature stability, and ease of electrochemical processing. Nickel inverse opals were fabricated by electrodeposition through a polystyrene (PS) opal template which was first deposited on surface treated gold film evaporated on Si wafer. PS opals formed from microspheres ranging in diameter from 460 nm to 2.2 μm were used as templates; these examples focuses on metal inverse opals formed using 2.2 μm microspheres. Templated electrodeposition was observed in all systems; this range of microsphere diameters is not an upper or lower limit. The final thickness of the sample was regulated by controlling the total charge. After electrodeposition, the PS microspheres were removed with tetrahydrofuran, resulting in a nickel inverse opal. Although the electrodeposition was quite homogeneous, gradual thickness variations do occur over the sample surface. These variations turn out to be useful, as they generated regions of different number of layers and surface terminations over the same sample (FIG. 1). SEM reveals a direct correspondence between the color, green, red or yellow, and the surface termination. As the color goes from green to red to yellow, the surface topography goes from shallow to deep bowl-like features, to deep cavities with openings at the top, as expected for electrodeposition through a layer of colloidal particles.

The reflectivity of a nickel inverse opal with varying surface termination was collected at normal incidence using an FTIR microscope (FIG. 1*c*). The three different surface terminations exhibited very different properties, and agreed qualitatively with previous observation on monolayer cavity structures.[15] The data was consistent with a model where the optics are essentially due to a combination of Bragg plasmon and Mie plasmon interactions in the top layer of the structure.[15] Light does not directly penetrate into the structure due to the small skin depth of nickel (~20 nm in near to mid IR) and the small size of the windows that connect the spherical cavities (SEM micrographs in FIG. 1). Despite the fact that Bragg surface plasmon modes and TM Mie plasmon modes can have strong fields near the metal surface,[16] which can result in propagation of light through a porous metal film,[17] experimentally it was observed that plasmon based propagation of light into the structure was minimal. This was probably because the geometry of the top layer was different from that of interior layers, limiting the overall plasmon coupling efficiency.

To increase the penetration depth of light, and thus explore the effect of three-dimensional periodicity on the optical properties, the windows that interconnect the spherical cavities were enlarged. A preferred route rather was to homogeneously remove metal from the metal inverse opal by electro-etching, a procedure commonly known as electropolishing, after removal of the colloidal template. Through control of the etching kinetics, the nickel inverse opals were uniformly etched through their entire thickness (FIG. 2*b*). The result of this etching can be structurally modeled as an increase in the diameter of the spherical cavities. The nickel filling fraction after etching was determined by SEM measurements.

Figure 2:
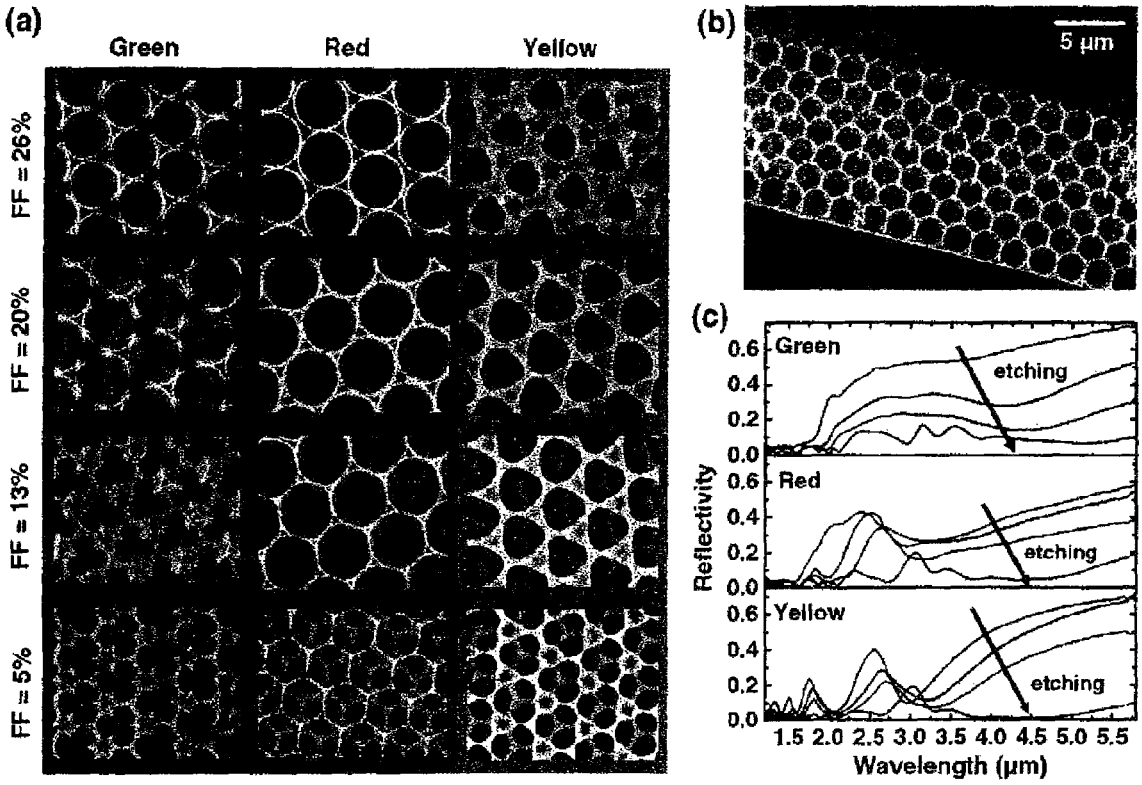
FIGS. 2(*a*)-(*c*). Increased structural openness by electropolishing: (a) Top view SEM images of nickel inverse opal of different surface topographies and structure openness. The four rows present nominal nickel filling fractions of 26% (as deposited), 20%, 13%, and 5%. The three columns correspond to the three different surface topographies described in FIG. 1. (b) SEM image of nickel inverse opal cross-section after etching (nickel filling fraction=13%). Etching is uniform throughout the thickness of the structure. (c) Reflectivity evolution as nickel filling fraction reduces. Spectra are from the green, red and yellow regions. For each color region, the traces correspond to a filling fraction of 26% (black), 20% (red), 13% (green), and 5% (blue); matching the SEM images in (a). All SEM images and reflective spectra are taken on the same 4 to 5 layer thick sample.

The optical properties as a function of structural openness were determined by successive electropolishing steps followed by measurements of optical properties. After each etching step, SEM images were collected to verify the amount of nickel removed. All spectra were collected from the same region of the sample. FIG. 2 presents both the reflectivity evolution and SEM images of the three distinct surface topographies (three color areas) as the nickel volume fraction was reduced. The optical properties changed dramatically as the interconnections between voids become larger and the nickel filling fraction was reduced. As nickel was removed, the reflectivity generally decreased and the main features in the spectra shifted to longer wavelengths. The most dramatic change was that the reflectivity spectra of three different color areas, which initially were quite different, become fairly similar. Light now propagated deep into the structure and surface effects became much less important. The optical properties of the structure were now truly three-dimensional.

Figure 3:
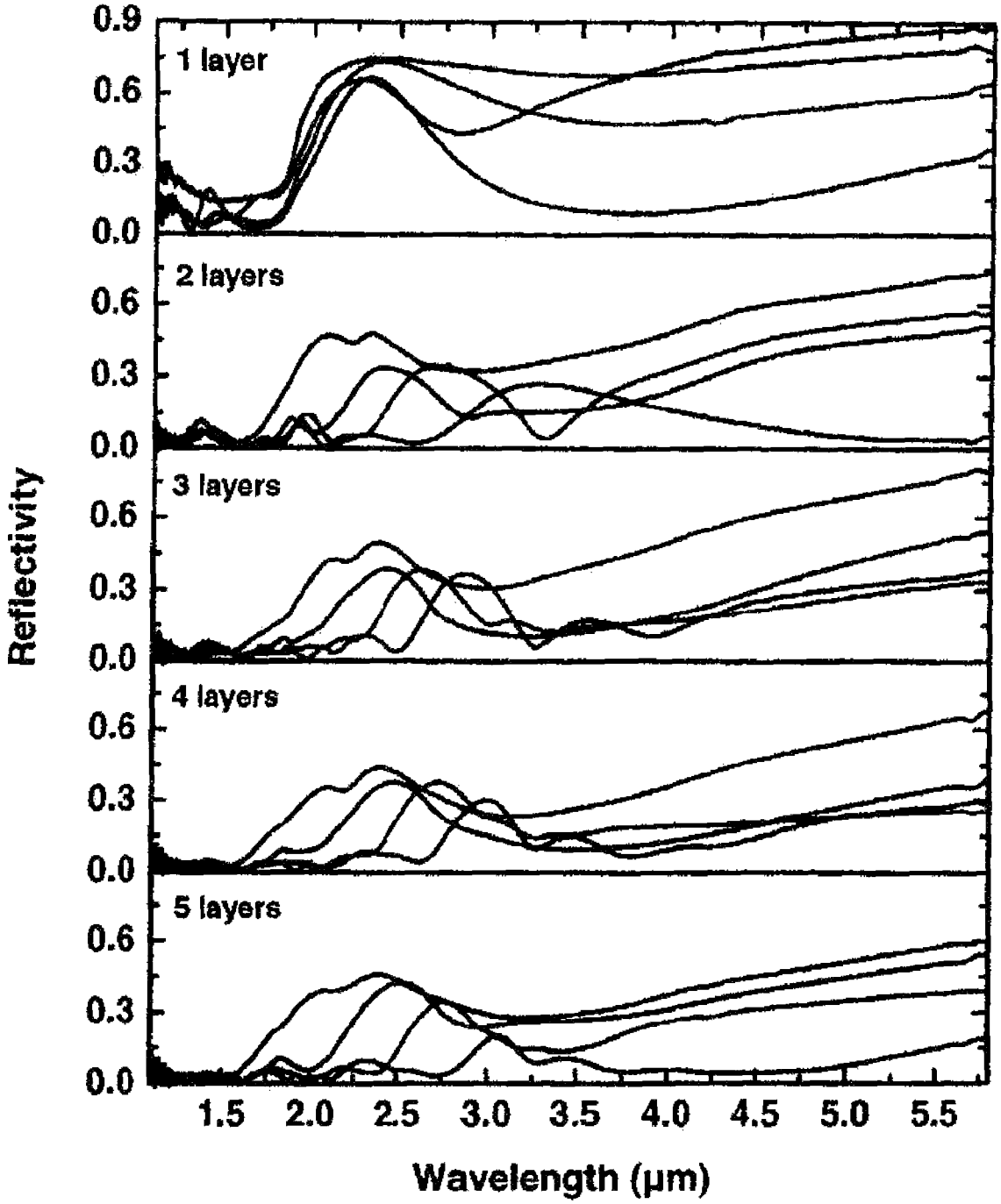
FIG. 3. Nickel inverse opal reflectivity as a function of thickness and filling fraction. Reflectance spectra collected from 1 to 5-layer thick samples terminated with the "red" topography. Within each set of spectra, the color scheme corresponds to the four different nickel filling fractions presented in FIG. 2.

To determine the penetration depth of light into the nickel inverse opal, the reflectivity as a function of the number of layers and metal filling fraction was measured from samples one to five layers thick (FIG. 3), each partially or completely formed layer was counted as one layer. Only the red color area was presented in FIG. 3, the other two color areas exhibited similar behavior. In each graph, the four curves correspond to the four levels of etching exhibited in FIG. 2*a*. Before etching, the spectra of all five samples were nearly identical, confirming that light was only interacting with the surface layer. As the structure opened up, spectra from samples of different thickness diverged. After the first etching step (red trace), the monolayer optical properties are different than the multilayer samples, but all multilayer samples are similar. By the final etching step (blue trace), the four and five layer samples were still similar, but the optical properties of the monolayer through three layer samples were different. Qualitatively, this data indicated that light substantially penetrated three to four layers into the fully etched samples (~5% nickel by volume). The limited penetration depth was further confirmed by the less than 1% transmission through a free standing six layer sample consisting of ~5% nickel by volume, over all investigated wavelengths.

Figure 4:
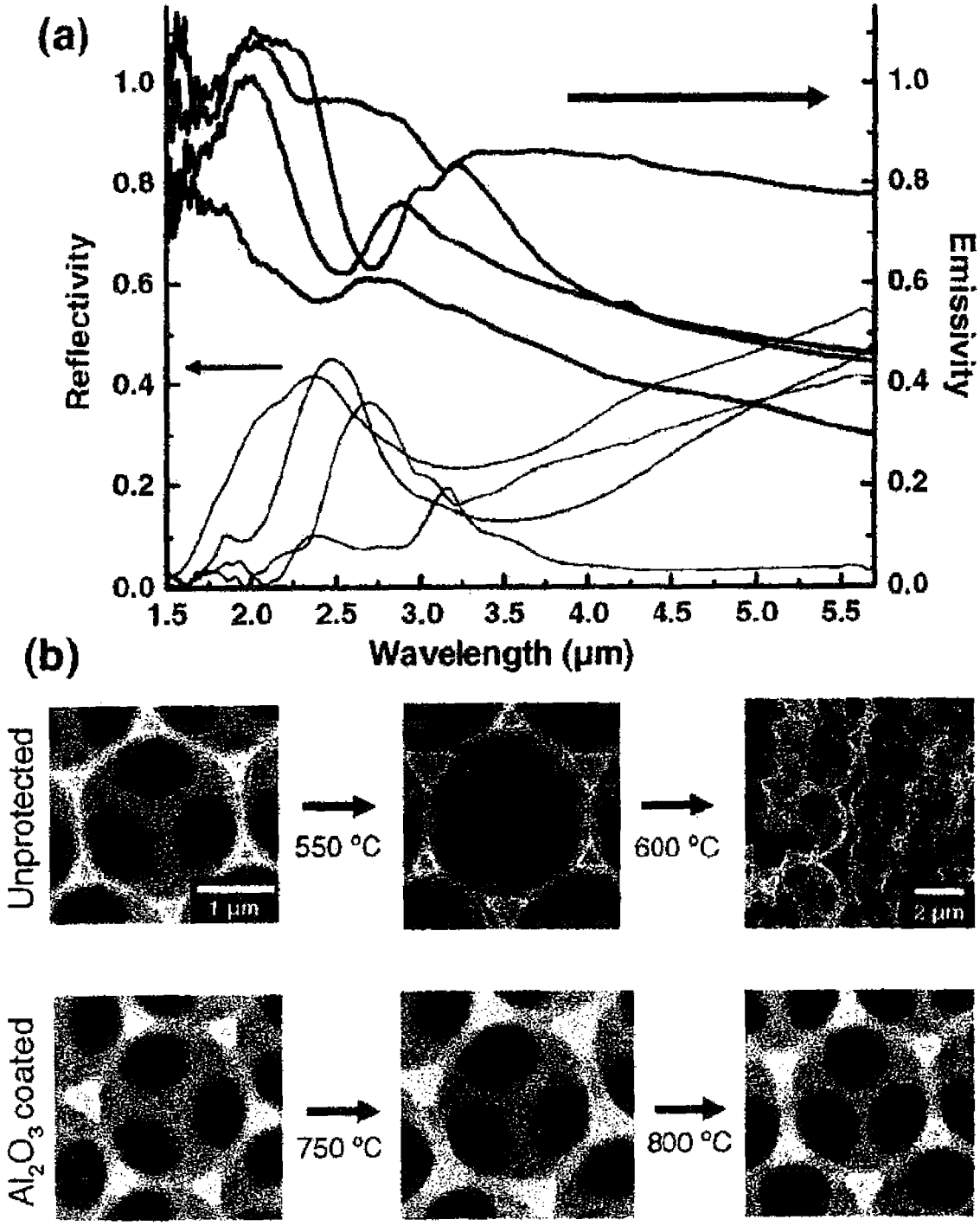
FIG. 4(*a*) and (*b*). Emission and thermal stability of nickel inverse opal: (a) Reflectivity and emissivity measured from red topography area of nickel inverse opals are plotted together. Samples heated to ~450° C. for emission studies. Each pair of lines are taken from the same spot of a sample at the same filling fraction. Filling fractions correspond to those presented in FIG. 2. Thick lines (emissivity) closely match one minus the thin lines (reflectivity), as expected. (b) Top view SEM images of nickel inverse opal after heat treatment at various temperatures. The top row is an unprotected structure, the bottom row an $Al_2O_3$ protected nickel structure. Images are taken after holding the sample at the indicated temperature for one hour under a reductive atmosphere. All images are the same magnification except for the top right image, which is presented at a lower magnification as indicated to more clearly show the structural collapse.
Figure 5:
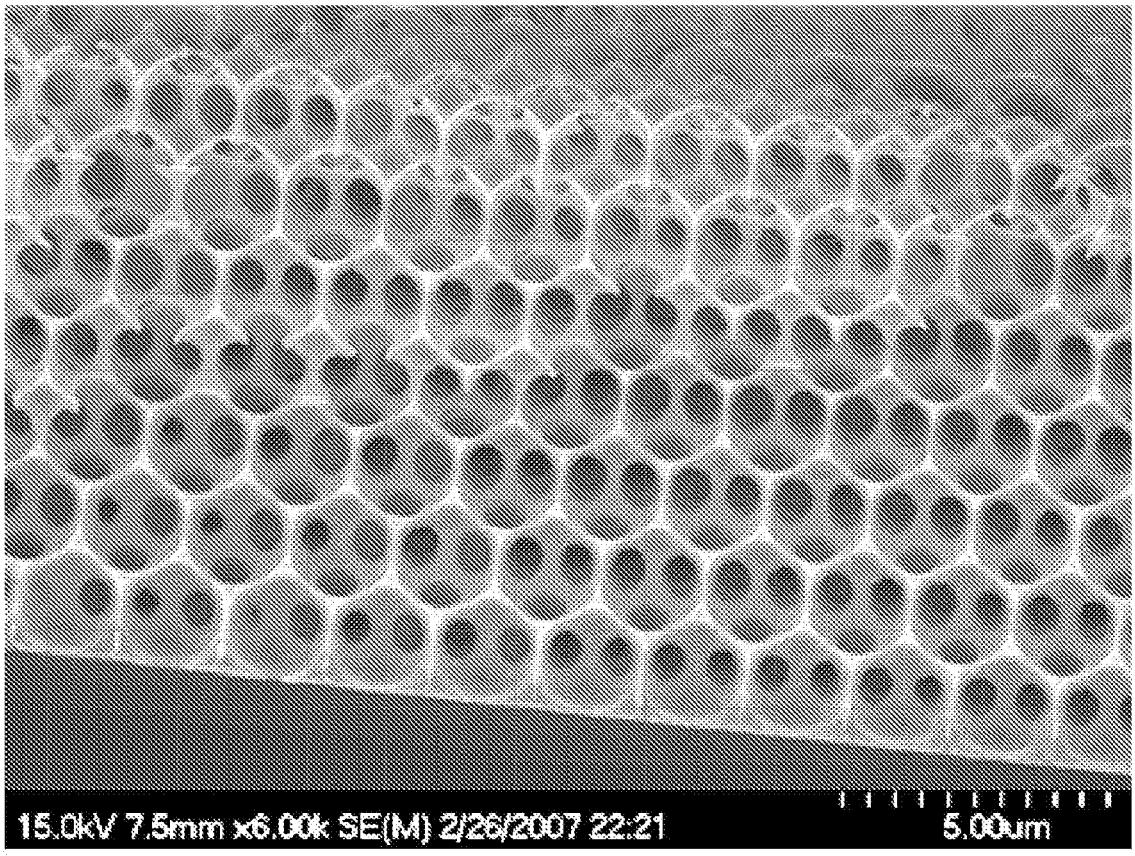
FIG. 5. SEM image of nickel inverse opal, after electropolishing.

The thermal emission properties of metallic photonic crystals have been of considerable interest.[2, 5, 18] Kirchoff's law states that emissivity ($\in$) and absorptance ($\alpha$) of an object are equal for systems in thermal equilibrium. For the nickel inverse opals studied here, where transmission was negligible and Bragg scattering from the triangular pattern at the surface did not occur at wavelengths longer than ~1.9 μm for 2.2 μm spheres, in the sample normal direction, $\in=\alpha=1-R$ with R being reflectivity. Emission measurements were performed by heating the nickel photonic crystal to ~450° C. in a reductive atmosphere (5% $H_2$ in Ar); the thermal emission was collected by the FTIR microscope. Emissivity was obtained by normalizing the emission from the Ni samples to that from the reference blackbody, a carbon black coated silicon wafer heated to the same temperature under Ar (FIG. 4*a*). Emissivity from samples of different structural openness, ranging from 26% to 5% Ni by volume as before, was plotted together with reflectivity. Only data taken from the red color area is presented, data from other two color areas show similar effects. Spectra were grouped in pairs: each pair of the same color belongs to the same structure openness. Emssivity appears as a mirror image of reflectivity ($\in=1-R$) even down to fine details for all wavelengths above 2 μm, confirming that the emission from the metal photonic crystal was modulated in a similar fashion as the reflectance. For wavelengths below 2 μm, the relationship disappears as Bragg scattered light was not collected, leading to an underestimation of the reflectivity. Emissivity in some cases slightly exceeded 1, almost certainly because the surface temperature of the nickel samples was slightly higher than that of the reference sample; a temperature difference of ~5° C. is sufficient to explain this result. The emission of the carbon black sample was greater, and thus it was slightly cooler than the metal inverse opals, even though the temperature of the substrate heater was the same for both experiments.

A nickel inverse opal can be heated to ~550° C. without structural degradation. However once heated to 600° C., it significantly collapses, even under a reductive atmosphere (FIG. 4*b*). For thermal emission applications, it may be desirable for the metal structure to survive at higher temperature, for example, at 700° C., blackbody emission peaks near 3 μm. To protect the inverse opal structure, a 50 nm layer of $Al_2O_3$ was coated on the sample via atomic layer deposition. No change was observed in reflectivity or SEM images before and after the sample was held at 750° C. for one hour under reductive atmosphere, the same treatment at 800° C. results in only slight changes, indicating the $Al_2O_3$ layer increases the working temperature of the nickel structure by at least 200° C.

The substrate was prepared by evaporating ~30 nm of gold on a 700 μm thick silicon wafer using 1 nm of chromium as an adhesion layer. It was then soaked in a saturated 3-Mercapto-1-propanesulfonic acid, sodium salt ($HS—(CH_2)_3-SO_3Na$) ethanol solution for 30 minutes forming a monolayer of hydrophilic molecules on the gold surface. 2.2 μm diameter sulfate terminated polystyrene spheres (Molecular Probes Inc.) were formed into an opal film on this substrate via evaporative deposition at 50° C. with a colloid volume concentration of 0.4% in water.[22] Ni was electrodeposited using the electrodeposition solution Techni Nickel S (Technic Inc.) under constant current mode (1 mA/cm$^2$) in a two electrode setup with a platinum flag as the anode. Electropolishing was performed using the solution, EPS1250 (Electro Polish Systems Inc.) under constant voltage mode (4V) in a two electrode setup with a stainless steel plate as cathode. Polishing was performed with 1 second pulses on 10 second intervals. The interval was selected to allow ions to diffuse in and out of the inverse opal between etching pulses. Optical measurements were carried out on a Bruker vertex 70 FTIR coupled with a Hyperion 1000 microscope. A $CaF_2$ objective (2.4×, NA=0.07) was used for all measurements. A Linkam THMS600 heating chamber with a KBr window was used to heat the sample. Gas flow was regulated at 2 liters per minute in all measurements. The substrate heater was set at 500° C. for all emission experiments. Due to thermal resistance of the substrate, surface temperature of the substrate was about 50° C. lower than that of the substrate heater. Temperature survivability studies were performed in a tube furnace (Lindberg Blue M) under a flowing reductive atmosphere (5% $H_2$ in Ar).

These experiments demonstrate that high quality three dimensional metallic photonic crystal structures can be made through a combination of colloidal crystal templated electrodeposition and electropolishing. Only after the structure was considerably opened up, allowing light to penetrate deep into the structure, did three-dimensional optical properties appear. Emission was indeed strongly modified by the photonic crystal. Because the experiments have probed nearly all possible degrees of structural openness and surface topographies, it was possible to determine the maximum possible modulation of the emission for an FCC inverse opal structure. Although this modulation may not be sufficient for some applications, the electrochemical infilling and etching approach described here is quite flexible and is compatible with other methods commonly used to generate three-dimensional photonic crystals, including laser holography,[19] direct writing,[20] and phase mask lithography.[21]

REFERENCES

1. W. Y. Zhang, X. Y. Lei, Z. L. Wang, D. G. Zheng, W. Y. Tam, C. T. Chan, P. Sheng *Phys. Rev. Lett.* 2000, 84, 2853-2856.
2. J. G. Fleming, S. Y. Lin, I. El-Kady, R. Biswas, K. M. Ho *Nature* 2002, 417, 52-55.
3. S. Y. Lin, J. Moreno, J. G. Fleming *Appl. Phys. Lett.* 2003, 83, 380-382.
4. E. Ozbay *Science* 2006 311, 189-193.
5. I. Puscasu, M. Pralle, M. McNeal, J. Daly, A. Greenwald, E. Johnson, R. Biswas, C. G. Ding *J. Appl. Phys.* 2005, 98, 013531.
6. M. I. Baraton, L. Merhari *Synth. React Inorg. Met.-Org. Nano Metal Chem.* 2005, 35, 733-742.
7. J. Banhart *Prog. Mater Sci.* 2001, 46, 559-632.
8. A. L. Pokroveky, V. Kamaev, C. Y. Li, Z. V. Vardeny, A. L. Efros, D. A. Kurdyukov, V. G. Golubev *Phys. Rev. B* 2005, 71, 165114.
9. W. J. Li, G. Sun, F. Q. Tang, W. Y. Tam, J. S. Li, C. T. Chan, P. Sheng *J. Phys.-Condes Matter* 2005, 17, 2177-2190.
10. G. von Freymann, S. John, M. Schulz-Dobrick, E. Vekris, N. Tetreault, S. Wong, V. Kitaev, G. A. Ozin *Appl. Phys. Lett.* 2004, 84, 224-226.
11. P. N. Bartlett, M. A. Ghanem, I. S. El Hallag, P. de Groot, A. Zhukov *J. Mater. Chem.* 2003, 13, 2596-2602.
12. B. H. Juarez, C. Lopez, C. Alonso *J. Phys. Chem. B* 2004, 108, 16708-16712.
13. P. N. Bartlett, J. J. Baumberg, S. Coyle, M. E. Abdelsalam *Faraday Discuss.* 2004, 125, 117-132.
14. P. N. Bartlett, P. R. Birkin, M. A. Ghanem *Chem. Commun.* 2000, 1671-1672.
15. T. A. Kelf, Y. Sugawara, J. J. Baumberg, M. Abdelsalam, P. N. Bartlett *Phys. Rev. Lett.* 2005, 95, 116802.
16. R. M. Cole, Y. Sugawara, J. J. Baumberg, S. Mahajan, M. Abdelsalam, P. N. Bartlett *Phys. Rev. Lett.* 2006, 97,
17. T. W. Ebbesen, H. J. Lezec, H. F. Ghaemi, T. Thio, P. A. Wolff *Nature* 1999, 391, 667-669.
18. D. L. C. Chan, M. Soljacic, J. D. Joannopoulos *Phys. Rev. E* 2006, 74, 016609.
19. M. J. Escuti, G. P. Crawford *Opt. Eng.* 2004, 43, 1973-1987.
20. G. M. Gratson, M. J. Xu, J. A. Lewis *Nature* 2004, 428, 386-386.
21. S. Jeon, J. U. Park, R. Cirelli, S. Yang, C. E. Heitzman, P. V. Braun, P. J. A. Kenis, J. A. Rogers *Proc. Natl. Acad. Sci. U.S.A.* 2004, 101, 12428-12433.
22. V. L. Colvin *MRS Bull.* 2001, 26, 637-641.
23. M. E. Leunissen, C. G. Christova, A. P. Hynninen, C. P. Royall, A. I. Campbell, A. Imhof, M. Dijkstra, R. van Roij, A. van Blaaderen, *Nature* 2005, 437, 235-240.
24. J. P. Hoogenboom, C. Retif, E. de Bres, M. V. de Boer, A. K. van Langen-Suurling, J. Romijn, A. van Blaaderen, *Nano Lett* 2004, 4, 205-208.
25. M. P. Valignat, O. Theodoly, J. C. Crocker, W. B. Russel, P. M. Chaikin, *Proc. Natl. Acad. Sci. U.S.A.* 2005, 102, 4225-4229.
26. W. B. Russel, *Nature* 2003, 421, 490-491.
27. G. M. Gratson, F. Garcia-Santamaria, V. Lousse, M. J. Xu, S. H. Fan, J. A. Lewis, P. V. Braun, *Adv. Mater.* 2006, 18, 461-.
28. Kim et al., U.S. Pat. No. 6,669,961 (Dec. 30, 2003).
29. A. P. Abbott, K. J. McKenzie, *Phys. Chem. Chem. Phys.* 2006, 8, 4265-4279.
30. F. Endres, S. Z. El Abedin, *Phys. Chem. Chem. Phys.,* 2006, 8, 2101-2116.
31. Electroplating engineering handbook. 4th ed. Van Nostrand Reinhold (New York 1984). ISBN: 0442220022.
32. Canning handbook on electroplating: polishing, electroplating, anodic oxidation, lacquering & bronzing. 21st ed. W. Canning (Birmingham, Eng. 1970). ISBN: 0419106308.
33. http://www.littelfuse.com/data/en/Data_Sheets/Littelfuse_MOV_CH.pdf (Last Updated: Jan. 11, 2007).
34. Sung et al., U.S. Patent Publication No. 2006/0140843 (Jun. 29, 2006).
35. Braun et al., U.S. Pat. No. 6,409,907 (Jun. 25, 2002).
36. Gates, B. & Xia, Y. *Adv. Mater.* 2000, 12, 1329-1332.
37. Park, S. H. & Xia, Y. *Chem. Mater.* 1998, 10, 1745-1747.
38. Gates, B., Yin, Y., Xia, Y. *Chem. Mater.* 1999, 11, 2827-2836.
39. van Blaaderen et al., *Nature* 1997, 385, 321.

The invention claimed is:

1. A method of making a monolithic porous structure, comprising:

electrodepositing a material on a template;

removing the template from the material, to form a monolithic porous structure comprising the material; and electropolishing the monolithic porous structure.

2. The method of claim 1, wherein the material comprises at least one metal or alloy.

3. The method of claim 1, wherein the material comprises Ni.

4. The method of claim 1, wherein the template comprises particles having a particle diameter of 1 nm to 100 μm.

5. The method of claim 1, wherein the template comprises particles having a particle diameter of 100 nm to 2 μm.

6. The method of claim 4, wherein the template has a three-dimensionally ordered structure.

7. The method of claim 4, wherein the template has a cubic close packed structure or a hexagonal close packed structure.

8. The method of claim 4, wherein the template comprises a polymer, a ceramic material or an organic material.

9. The method of claim 1, wherein the electropolishing reduces a filling fraction of the monolithic porous structure to 1-25%.

10. The method of claim 1, wherein the electropolishing reduces a filling fraction of the monolithic porous structure to 3-20%.

11. The method of claim 1, further comprising coating the monolithic porous structure, after the electropolishing.

12. The method of claim 11, wherein the coating comprises atomic layer deposition.

13. The method of claim 2, further comprising oxidizing the material.

14. The method of claim 3, further comprising oxidizing the material.

15. The method of claim 1, wherein:

the material comprises at least one metal, the template comprises particles having a particle diameter of 100 nm to 2 μm, the template has a cubic close packed structure or a hexagonal close packed structure, and the electropolishing reduces a filling fraction of the monolithic porous structure to 1-25%.

16. The method of claim 15, further comprising coating the monolithic porous structure, after the electropolishing.

17. The method of claim 15, further comprising oxidizing the material.

18. The method of claim 15, wherein the material comprises Ni.

* * * * *